US006718583B1

(12) United States Patent
Diaz

(10) Patent No.: US 6,718,583 B1
(45) Date of Patent: Apr. 13, 2004

(54) FIRE-RETARDANT MATTRESS

(76) Inventor: Vincent Diaz, 2303 Tide Cir., Havre de Grace, MD (US) 21078

( * ) Notice: Subject to any disclaimer, the term of this patent is extended or adjusted under 35 U.S.C. 154(b) by 0 days.

(21) Appl. No.: 10/261,895

(22) Filed: Oct. 1, 2002

(51) Int. Cl.[7] ..... A47C 27/00
(52) U.S. Cl. ..... 5/698; 5/737; 5/739; 297/DIG. 5
(58) Field of Search ..... 5/698, 737, 739; 297/DIG. 5

(56) References Cited

U.S. PATENT DOCUMENTS 3,818,521 A * 6/1974 Richards, Jr. ..... 5/698
3,889,305 A * 6/1975 Goldberg ..... 5/698
4,430,765 A * 2/1984 Karpen ..... 5/698
4,463,464 A * 8/1984 Bost et al. ..... 297/452.61
4,504,991 A * 3/1985 Klancnik ..... 5/698
5,272,779 A * 12/1993 Payton ..... 5/698
5,578,368 A * 11/1996 Forsten et al. ..... 442/407

* cited by examiner

*Primary Examiner*—Michael F. Trettel
(74) *Attorney, Agent, or Firm*—Armstrong, Kratz, Quintos, Hanson & Brooks, LLP

(57) ABSTRACT

A fire retardant mattress, sofa cushion and pillow has a foam base which is covered by a fire barrier material. A ticking covers the fire barrier material. Sheets of these combined materials are formed into a top, a bottom and sidewalls for the mattress. The intersecting planar surfaces are formed as a flange which is sandwiched between a fire-retardant treated edge binding tape. The flange is sewn with a fire retardant thread to encapsulate the mattress with fire retardant components.

8 Claims, 4 Drawing Sheets

FIRE-RETARDANT MATTRESS

BACKGROUND OF THE INVENTION

1. Field of the Invention

The present invention relates to a mattress which is fire-retardant and does not burn when exposed to elevated temperatures and flame.

2. Description of Related Art

In the United States mattress fires cause the deaths of approximately 500 people each year. One of the main causes of these fires is children playing with matches.

The incidence of mattress fires throughout the United States is such that the industry has formed committees to attempt to establish standards for testing flammability of mattresses. The state of California enacted regulations in 2001 which requires all mattresses to be sold effective January 2004 to meet the performance requirements of California Technical Bulletin 129. The Consumer Product Safety Commission is considering regulations which would require that mattresses be required to pass an open flame test which would be mandatory nationwide.

The foam used within the mattress for cushioning, is a potential source of fuel which can be ignited and quickly engulf the mattress in flames. The foam is highly flammable. Not only is the foam flammable, but when burning, it emits noxious fumes. Furthermore, in the construction of the mattress, the sewing thread, used to secure the perimeter of the mattress, which is a thread made of nylon or other fibers. These threads are flammable and will melt when exposed to direct flame. The flammability of the present mattresses is aggravated by these types of thread. These threads melt at the temperature of a burning match, which is approximately 460° F. When the thread is destroyed the structural integrity of the mattress is destroyed. The flame frequently travels around the periphery of the mattress where the threads join the top and the sidewalls. This flame then ignites the foam within the mattress which fuels the fire to a catastrophic event.

There is interest from the ASTM International, a national consensus standards organization, on this subject. Specifically, Subcommittee E5-15 which is responsible for household furnishings, has initiated the development of a standard to evaluate the performance of components which can be used to improve the ability of mattresses to withstand an open flame.

In a related area, aircraft seat manufacturers are concerned about the flame resistance of the seats to meet the performance requirements of Federal Aviation Regulations (FAR) 25.833.

BRIEF SUMMARY OF THE INVENTION

It is an object of the present invention to provide a mattress, a sofa cushion and a pillow which, when exposed to an open flame, will not burn.

It is a further object of the present invention to provide a fire retardant mattress which is easily produced and is economical to manufacture.

It is another object of the present invention to provide a fire retardant mattress which will meet the requirements established by government agencies.

In accordance with the teachings of the present invention, there is disclosed a fire-retardant mattress, sofa cushion, pillow or the like, comprising a foam base, a fire barrier material, a tape covering the intersecting planar surfaces of the mattress and forming an edge binding for the mattress around the perimeter thereof. The fire barrier material is sandwiched between the edge binding, thereby forming a laterally-projecting flange. The flange is held together by a stitched fire-retardant sewing thread. The thread and the tape of the edge binding are capable of withstanding very high temperatures without rendering the foam vulnerable to the flames, and yet retaining the structural integrity of the mattress as a whole.

In further accordance with the teachings of the present invention, there is disclosed a method of making a fire-retardant mattress, sofa cushion, pillow or the like. There is provided a frame, a foam base, a fire barrier material substantially covering the foam base and a ticking covering the fire barrier material, thereby forming a sheet of material. The sheet of material is formed into a top, a bottom and a sidewall for the frame and defining planar surfaces. A laterally projecting flange is formed around the perimeter of the mattress, sofa cushion and pillow. The flange is formed from the foam, the fire barrier material and the ticking at the intersecting planar surfaces of the mattress, the sofa cushion and the pillow. A fire-retardant treated edge binding tape is disposed over the laterally projecting flange such that the flange is sandwiched between the edge binding tape. The edge binding tape is sewn over the laterally-projecting flange with a fire-retardant thread, thereby securing the edge binding. In this manner the mattress, sofa cushion and pillow are capable of withstanding very high temperatures and open flame while retaining structural integrity.

These and other objects of the present invention will become apparent from a reading of the following specification taken in conjunction with the enclosed drawings.

DESCRIPTION OF THE PREFERRED EMBODIMENTS

Figure 1:
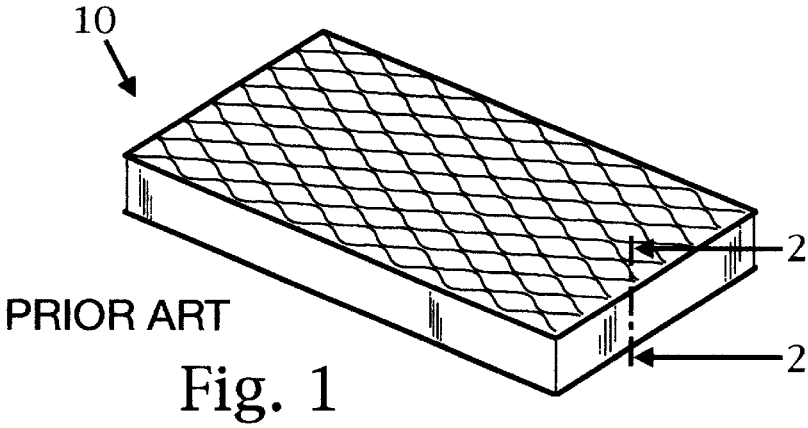
FIG. 1 is a perspective view of a mattress of the prior art.
Figure 2:
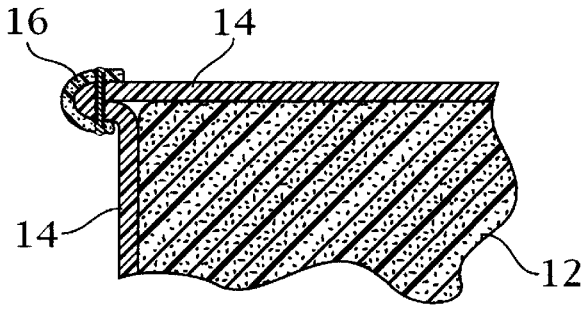
Fig. 2 PRIOR ART
FIG. 2 is a cross-sectional view taken across the lines 2—2 of FIG. 1.
Figure 3:
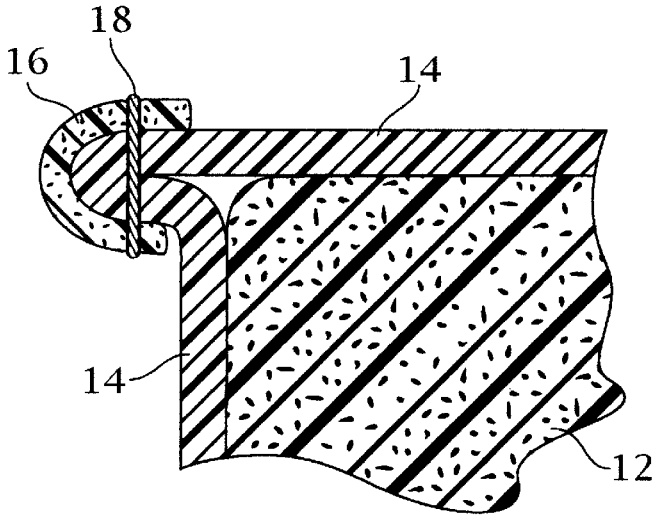
Fig. 3 PRIOR ART
FIG. 3 is an enlarged view of two intersecting planar surfaces of the mattress of FIG. 2.

Referring to FIGS. 1–4 in the prior art, a mattress 10 is formed by placing a flammable foam material 12 over a frame, usually having springs on the frame. A ticking 14 or dress cover fabric is made as a cover directly attached to the foam 12. The mattress 10 has a top, a bottom and four sidewalls connecting the top and bottom. These sidewalls intersect the perimeters of the planar top and bottom surfaces. At the intersection, the respective ticking are sandwiched between an edge binding 16 which encompasses the entire top perimeter. A similar edge binding 16 encompasses the entire bottom perimeter. The edge binding is sewn together to assemble the mattress.

Figure 4:
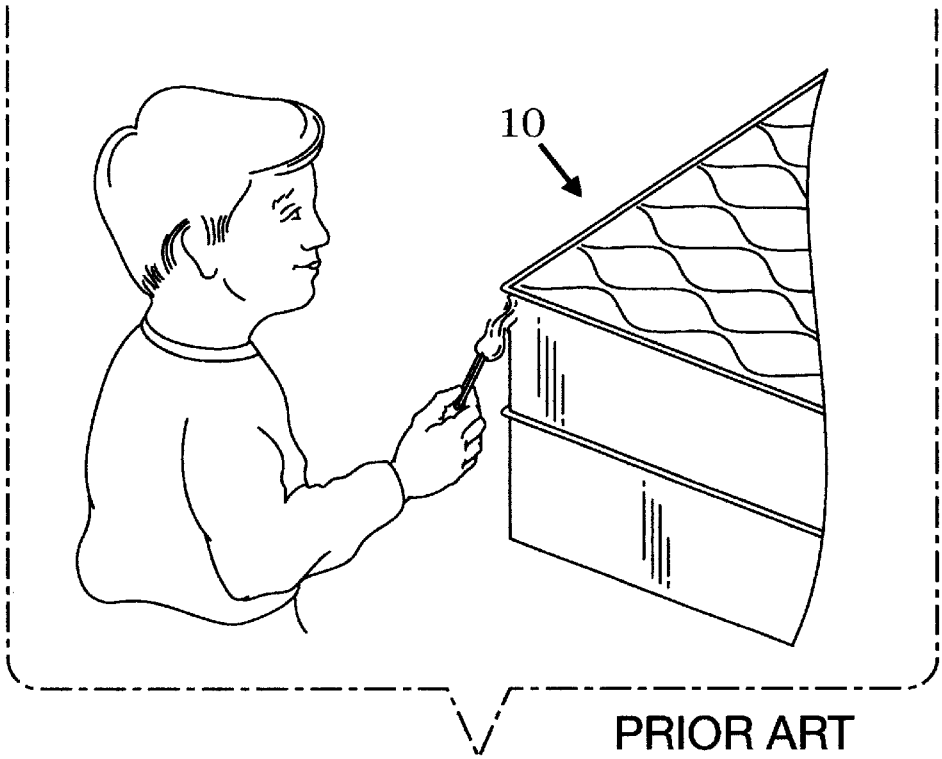
FIG. 4 is a diagram of ignition of the mattress of the prior art by a child playing with matches.

In the prior art, the ticking 14 is usually a polypropylene, polyester or nylon fabric. The edge binding 16 is generally made from an untreated polyester material. The edge binding and ticking are sewn together using a polymeric thread 18. None of the component materials are usually made from fire retardant or flame resistant material. When exposed to elevated temperatures or an open flame, all of the components will burn or melt to fuel the fire and/or to deform and no longer retain the shape of the mattress. One of the major causes of mattress fires is children playing with matches (FIG. 4).

Figure 5:
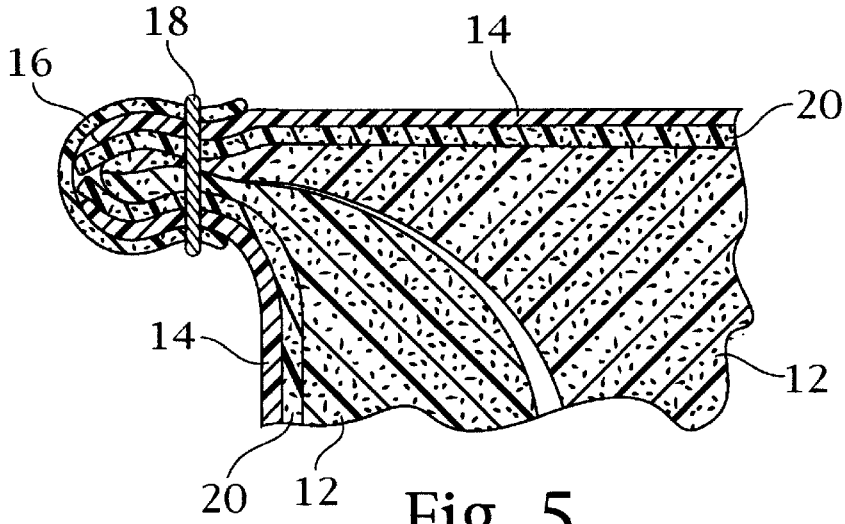
FIG. 5 is a cross-sectional view of the two intersecting planar surfaces of the mattress of the present invention.

In the present invention, FIG. 5, the ticking 14 is attached to a first face of a fire barrier material 20. A preferred fire barrier material is an aramid fiber which is made by E.I. DuPont de Nemours & Co. and sold as KEVLAR®. Other known fire barrier materials which are known are preoxidized acrylic and fiberglass. The acrylic material and the fiberglass are both uncomfortable on the skin of persons and are less desirable for use in mattresses. The ticking 14 is preferably sewn to the fire barrier material 20. On the opposite face of the fire barrier material 20, the foam 12 is attached. The fire barrier material 20 preferably has a weight ranging from 2 oz./sq. yd. to 5 oz./sq. yd. This defines a thickness of the fire barrier material 20 which can withstand an open flame for a sufficient time to be considered to provide a fire retardant mattress.

Figure 6:
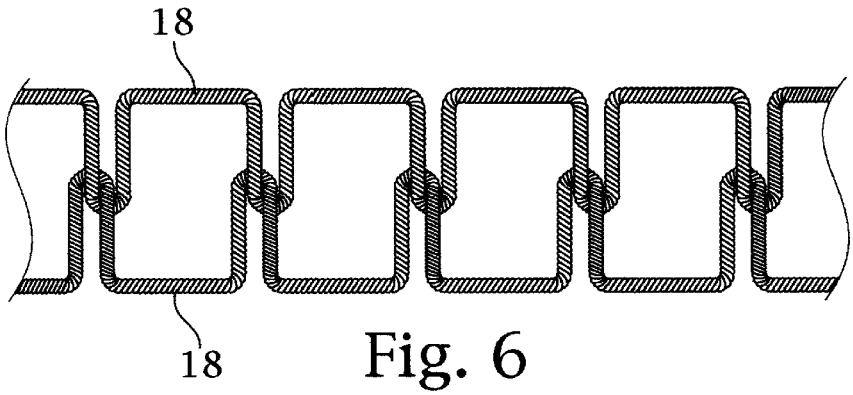
FIG. 6 is a diagramatic view of a chain stitch.
Figure 7:
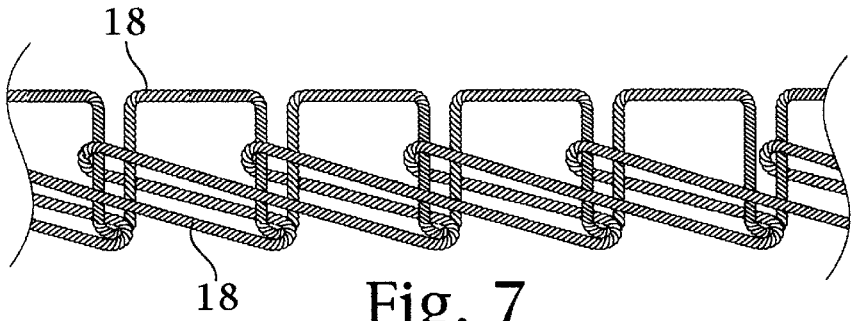
FIG. 7 is a diagramatic view of a lock stitch.

The top and bottom of the mattress 10 are usually made, using much thicker foam 12. The sidewalls of the mattress usually have a thinner foam. The sidewalls intersect the perimeters of the top and bottom surfaces of the mattress. At the intersection, as shown in FIG. 5, the foam 12 layer of the outer edges of the top (and the bottom) are placed adjacent to the foam 12 layer of the sidewall. The respective ticking 14 of the top (and the bottom) are disposed distal from the ticking on the sidewalls. The edges are sandwiched between the folded edge binding tapes 16 which encompass the entire perimeter of the top and the bottom of the mattress 10. The foam 12 layers are compressed within the folded edge binding tapes 16 and the edge binding tapes are sewn with a thread 18 preferably using a lock stitch or a chain stitch (FIGS. 6–7) in accordance with stitch type 301 or 401 of ASTM D6193.

The edge binding tape 16 of the present invention preferably is a polyester material which is treated for flame retardency. The treated tape can also withstand washing .

The thread 18 of the present invention preferably is formed from material which is fire resistant such as aramid fiber. CRAQ-SPUN® sewing threads made of aramid fibers provided by Atlantic Thread and Supply Co., Inc. has been used successfully as the thread. The thickness of the thread may be selected for strength and cost. It is possible to use one thickness of thread in the needle thread of the sewing machine and a different thickness of thread in the bottom thread of the sewing machine. By a proper selection of thread thickness, the overall strength of the seam can be adjusted. The strength of the seam is an important factor because the foam portion of the top (and bottom layer) is very thick and is highly compressed when sandwiched in the edge binding 16 with the thinner layer of foam from the sidewalls. The thread 18 must be strong enough to resist the stress of the compressed foam 12, the fire barrier material 20 and the ticking 14 which are all sandwiched in the folded edge binding 16.

Figure 8:
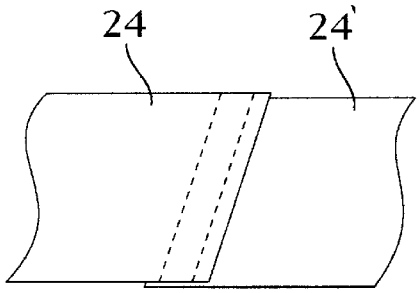
FIG. 8 is a perspective view of overlapping ends.
Figure 9:
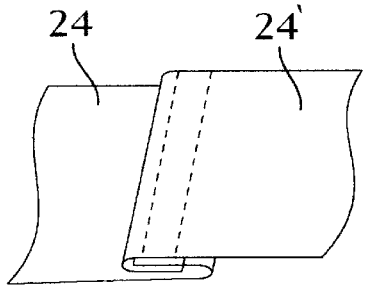
FIG. 9 is a perspective view of another embodiment of overlapping ends.
Figure 10:
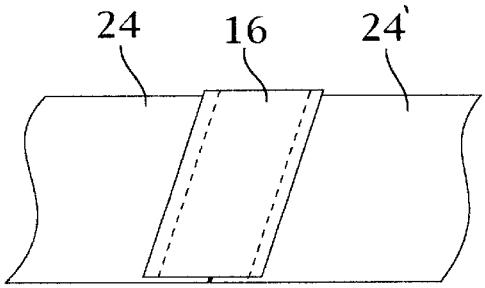
FIG. 10 is perspective view of a further embodiment of overlapping ends.

In manufacturing the mattress, the foam 12, the fire barrier material 20 and the ticking 14 are assembled in a single sheet which is large enough to form the respective planar surfaces of the top and bottom of the mattress. These are disposed on the frame. The sidewall 22 is usually formed from a single length of the assembled foam 12, fire barrier material 20 and ticking 14. The length of sidewall is placed around the frame and the top and bottom flanges are formed with the sidewall 22. The opposite ends 24, 24' of the sidewall 22 are overlapped and sewn together. Preferably, the foam 12 and ticking 14 are removed from the overlapping segments. If the foam and ticking are not removed, there is a possibility that, when exposed to an open flame, the foam and/or the ticking could ignite and the fire could travel through the overlapped segments and reach the foam within the mattress. This would compromise the fire retardant features of the mattress. FIGS. 8–10 show alternate overlapping seams which are recommended. These seams are made in accordance with ASTM D6193. FIG. 8 shows overlapping of the opposite ends 24, 24' of the sidewall and seaming with one or more rows of stitches. FIG. 9 shows the folding in and overlapping of the opposite ends 24, 24' of the sidewall so that the ends are concealed and seaming with one or more rows of stitching. FIG. 10 shows the overlapping of a strip of fire retardant material on the abutted opposite ends 24, 24' of the sidewalls and seaming with two or four rows of stitching. If the opposite ends 24, 24' of the sidewall 22 were simply butted together without any overlapping, the mattress would not withstand an open flame. The flame would ignite the foam 12 which would be exposed at the butted joint and the foam within the mattress 10 would burn. All of the overlapping seams are sewn with the fire retardant thread 18.

Figure 11A:
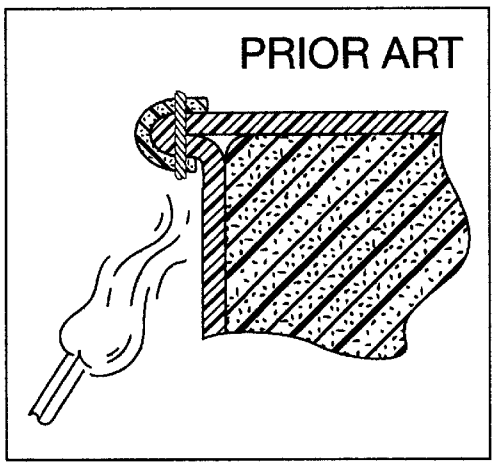
FIG. 11A has a cut-away view showing a flame applied to the prior art mattress.
Figure 11B:
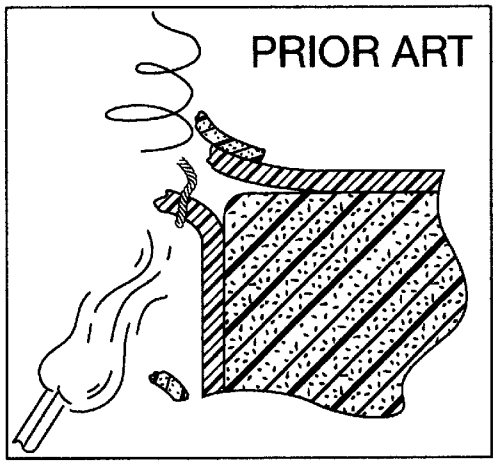
FIG. 11B has a cut-away view showing FIG. 11A and the stitching melted and the tape burning.
Figure 11C:
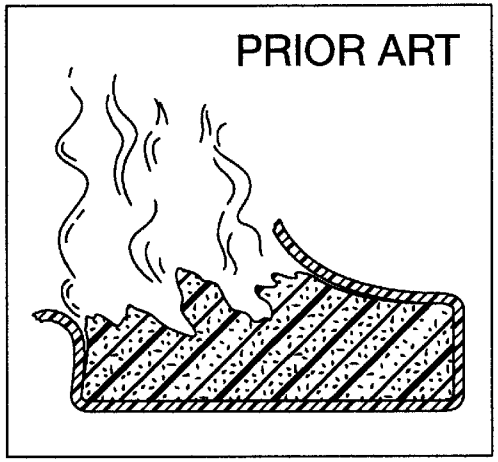
FIG. 11C has a cut-away view showing FIG. 11A with the entire mattress burning.
Figure 11D:
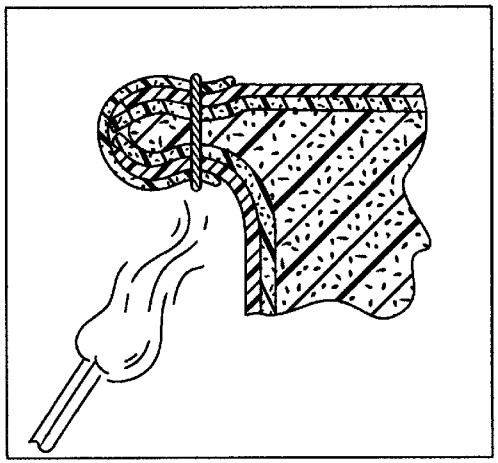
FIG. 11D is a cut-away view showing a flame applied to the present invention.
Figure 11E:
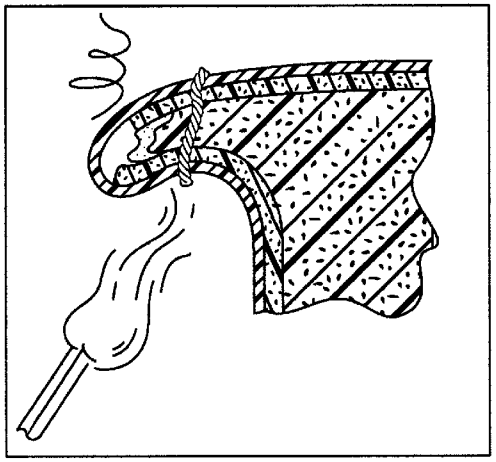
FIG. 11E is a cut-away view showing FIG. 11D retaining integrity after exposure to the open flame.

The effectiveness of the fire retardant properties of the present invention has been extensively tested against an open flame in accordance with California Technical Bulletin 129. This requires a methane flame at 1,200° F. which is much more severe than a burning match which burns at approximately 460° F. The continuous exposure time to the open flame is for three (3) minutes. After three (3) minutes, the ticking in the vicinity of the flame has been consumed or has melted. There is charring of the ticking around the outer areas which have been exposed to the flame. Also, charred remnants of the ticking cover the fire barrier material 20 (the aramid). The edge binding 10 is darkened and is somewhat embrittled, but is intact. The thread 18 through the flange is unaffected and retains the flange in its original shape. The mattress successfully passed this vigorous test (FIGS. 11D–11E).

It was noted that after the open flame was removed, an afterflame was occasionally observed on the flange, usually at the edges of the area exposed to the open flame. This was due to burning of the compressed foam which was in the flange. The afterflame burned out in a short time and did not ignite adjacent portions of the flange nor did it ignite the foam within the mattress.

If the thread is made from a polymeric fiber, as is presently used in the contemporary non-fire retardant mattresses, it has been found that these polymeric fibers melt. The edge binding tape is not retained over the flange and the foam is ignited. The mattress does not withstand the open flame test when nylon thread is used, even with the fire barrier material and the treated edge binding (FIGS. 11A–11C).

The present invention is an overall system to encapsulate the foam which is in the mattress and to prevent the foam from burning. The system is the fire barrier material (aramid), the treated edge binding tape and the fire resistant thread (aramid) in which the three components are interdependent. The system withstands an open flame and safeguards the structural integrity of the mattress to prevent ignition of the foam. The present invention solves a long-standing problem which the mattress and furniture industry has recognized and has not resolved.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A fire-retardant mattress, sofa cushion, pillow or the like, comprising a foam base, a fire barrier material substantially covering the foam base, a ticking covering the fire barrier material, a tape forming an edge binding for the mattress around the perimeter thereof, the fire barrier material being sandwiched between the edge binding, thereby forming a laterally-projecting flange, and the flange being held together by a stitched fire retardant sewing thread, the thread and the tape of the edge binding being capable of withstanding very high temperatures without rendering the foam vulnerable to the flames, and yet retaining the structural integrity of the mattress as a whole, wherein the foam base is attached to the fire barrier material and is sandwiched between the edge binding together with the fire barrier material and forming the laterally projecting flange.

2. The fire retardant mattress of claim 1, wherein the fire barrier material is aramid.

3. The fire retardant mattress of claim 2, wherein the fire barrier material has a weight ranging from 2 oz./sq. yd. to 5 oz./ sq. yd.

4. The fire-retardant mattress of claim 1, wherein the stitched fire retardant sewing thread is formed from aramid fiber.

5. The fire retardant mattress of claim 1, wherein the tape is treated to be fire-retardant.

6. The fire-retardant mattress of claim 1, wherein the mattress has a top, a bottom and four sides connecting the top and the bottom, the entire top and the entire bottom being covered with the fire retardant material, the fire retardant material covering all four sides, having a first end and a second end, a segment of the first end overlapping a segment of the second end and the overlapping segments being sewn together.

7. A method of making a fire-retardant mattress, sofa cushion, pillow or the like, comprising the steps of:

providing a frame, providing a foam base, a fire barrier material substantially covering the foam base and a ticking covering the fire barrier material, thereby forming a sheet of material, forming the sheet of material into a top, a bottom and a sidewall for the frame and defining planar surfaces, forming a laterally projecting flange around the perimeter of the mattress, sofa cushion and pillow, the flange formed from the foam, the fire barrier material and the ticking at the intersecting planar surface of the mattress, the sofa cushion and the pillow, disposing a fire-retardant treated edge binding tape over the laterally projecting flange such that the flange is sandwiched between the edge binding tape, sewing the edge binding tape over the laterally-projecting flange with a fire retardant thread, thereby securing the edge binding, such that the mattress, sofa cushion and pillow are capable of withstanding very high temperatures and open flame while retaining structural integrity.

8. A fire-retardant mattress, sofa cushion, pillow or the like, comprising a foam base, a fire barrier fabric substantially covering the foam base, a fire retardant tape forming an edge binding for the mattress around the perimeter thereof, the fire barrier fabric being sandwiched between the edge binding, thereby forming a laterally-projecting flange, and the flange being held together by a stitched fire retardant sewing thread, the thread and the fire retardant tape of the edge binding being capable of withstanding very high temperatures without rendering the foam vulnerable to the flames, and yet retaining the structural integrity of the mattress as a whole, wherein the foam base is attached to the fire barrier fabric and is sandwiched between the edge binding together with the fire barrier, fabric and forming the laterally projecting flange.

* * * * *